US010744803B2

(12) United States Patent
Honda

(10) Patent No.: US 10,744,803 B2
(45) Date of Patent: Aug. 18, 2020

(54) TENSION CONTROLLER, MEDIUM CONVEYING DEVICE INCORPORATING THE TENSION CONTROLLER, AND IMAGE FORMING APPARATUS INCORPORATING THE MEDIUM CONVEYING DEVICE

(71) Applicant: Ryo Honda, Kanagawa (JP)

(72) Inventor: Ryo Honda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/356,619

(22) Filed: Mar. 18, 2019

(65) Prior Publication Data

US 2019/0283472 A1 Sep. 19, 2019

(30) Foreign Application Priority Data

Mar. 19, 2018 (JP) ..... 2018-051384

(51) Int. Cl.
*B41J 15/16* (2006.01)
*B41J 11/00* (2006.01)
*B65H 23/00* (2006.01)

(52) U.S. Cl.
CPC ..... *B41J 15/16* (2013.01); *B41J 11/007* (2013.01); *B65H 23/00* (2013.01)

(58) Field of Classification Search
CPC ..... B41J 15/16; B41J 11/007; B56H 23/00
USPC ..... 347/104
See application file for complete search history.

(56) References Cited

U.S. PATENT DOCUMENTS

2011/0063391 A1 3/2011 Miyamoto et al.
2011/0180648 A1* 7/2011 Onozato ..... B41J 2/0057 242/412
2016/0130110 A1 5/2016 Honda et al.
2017/0217719 A1 8/2017 Honda
2018/0009244 A1* 1/2018 Saita ..... B41J 11/42

FOREIGN PATENT DOCUMENTS

| | | |
|---|---|---|
| JP | 11-091998 | 4/1999 |
| JP | 2006-151651 | 6/2006 |
| JP | 2011-062820 | 3/2011 |
| JP | 2012-206859 | 10/2012 |
| JP | 2015-129028 | 7/2015 |
| JP | 2016-102029 | 6/2016 |
| JP | 2018-008396 | 1/2018 |

* cited by examiner

*Primary Examiner* — Huan H Tran
*Assistant Examiner* — Alexander D Shenderov
(74) *Attorney, Agent, or Firm* — Oblon, McClelland, Maier & Neustadt, L.L.P.

(57) ABSTRACT

A tension controller includes a drive device configured to rotate a drive shaft, and a drive transmission device configured to transmit a rotation driving force of the drive shaft of the drive device to rotate a rotary shaft of a roll of a conveyance target medium. The drive transmission device including a tension applying device including a variable speed reducing device and a torque limiter, the variable speed reducing device and the torque limiter being disposed between the drive shaft of the drive device and the rotary shaft of the roll of the conveyance target medium. The variable speed reducing device of the tension applying device being configured to change a speed reduction ratio between the rotary shaft of the roll of the conveyance target medium and the torque limiter and to apply a tension force to the conveyance target medium.

7 Claims, 8 Drawing Sheets

TENSION CONTROLLER, MEDIUM CONVEYING DEVICE INCORPORATING THE TENSION CONTROLLER, AND IMAGE FORMING APPARATUS INCORPORATING THE MEDIUM CONVEYING DEVICE

CROSS-REFERENCE TO RELATED APPLICATION

This patent application is based on and claims priority pursuant to 35 U.S.C. § 119(a) to Japanese Patent Application No. 2018-051384, filed on Mar. 19, 2018, in the Japan Patent Office, the entire disclosure of which is hereby incorporated by reference herein.

BACKGROUND

Technical Field

This disclosure relates to a tension controller, a medium conveying device incorporating the tension controller, and an image forming apparatus incorporating the medium conveying device.

Related Art

Various types of image forming apparatuses to which such a tension controller is applied are known to include a configuration in which a roll sheet (or a roll medium) that functions as a conveyance target medium is conveyed to a printing portion and an image is printed on the roll sheet.

In a known roll sheet type recording device, a tension applying device of a roller sheet feeding device has a configuration in which multiple friction torque panels are attached with friction to an interlocking shaft via a torque transmission panel. As an electromagnetic clutch is turned on, a locking gear that meshes with a gear of each of the multiple friction torque panels is fixed to a locking shaft that is disposed parallel to a locking shaft. By contrast, as the electromagnetic clutch is turned off, the locking gear is rotated.

SUMMARY

At least one aspect of this disclosure provides a tension controller including a drive device and a drive transmission device. The drive device is configured to rotate a drive shaft. The drive transmission device configured to transmit a rotation driving force of the drive shaft of the drive device to rotate a rotary shaft of a roll of a conveyance target medium. The drive transmission device includes a tension applying device. The tension applying device includes a variable speed reducing device and a torque limiter. The variable speed reducing device and the torque limiter are disposed between the drive shaft of the drive device and the rotary shaft of the roll of the conveyance target medium. The variable speed reducing device of the tension applying device is configured to change a speed reduction ratio between the rotary shaft of the roll of the conveyance target medium and the torque limiter and to apply a tension force to the conveyance target medium.

Further, at least one aspect of this disclosure provides a medium conveying device including the above-described tension controller provided to at least one of a medium supplying device and a medium take-up device. The medium supplying device is disposed upstream from a sheet conveying device that conveys the conveyance target medium in a conveying direction and supplies the conveyance target medium. The medium take-up device is disposed downstream from the sheet conveying device in the conveying direction and take up the conveyance target medium.

Further, at least one aspect of this disclosure provides an image forming apparatus including the above-described medium conveying device and an image forming device configured to form an image on the conveyance target medium conveyed by the medium conveying device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
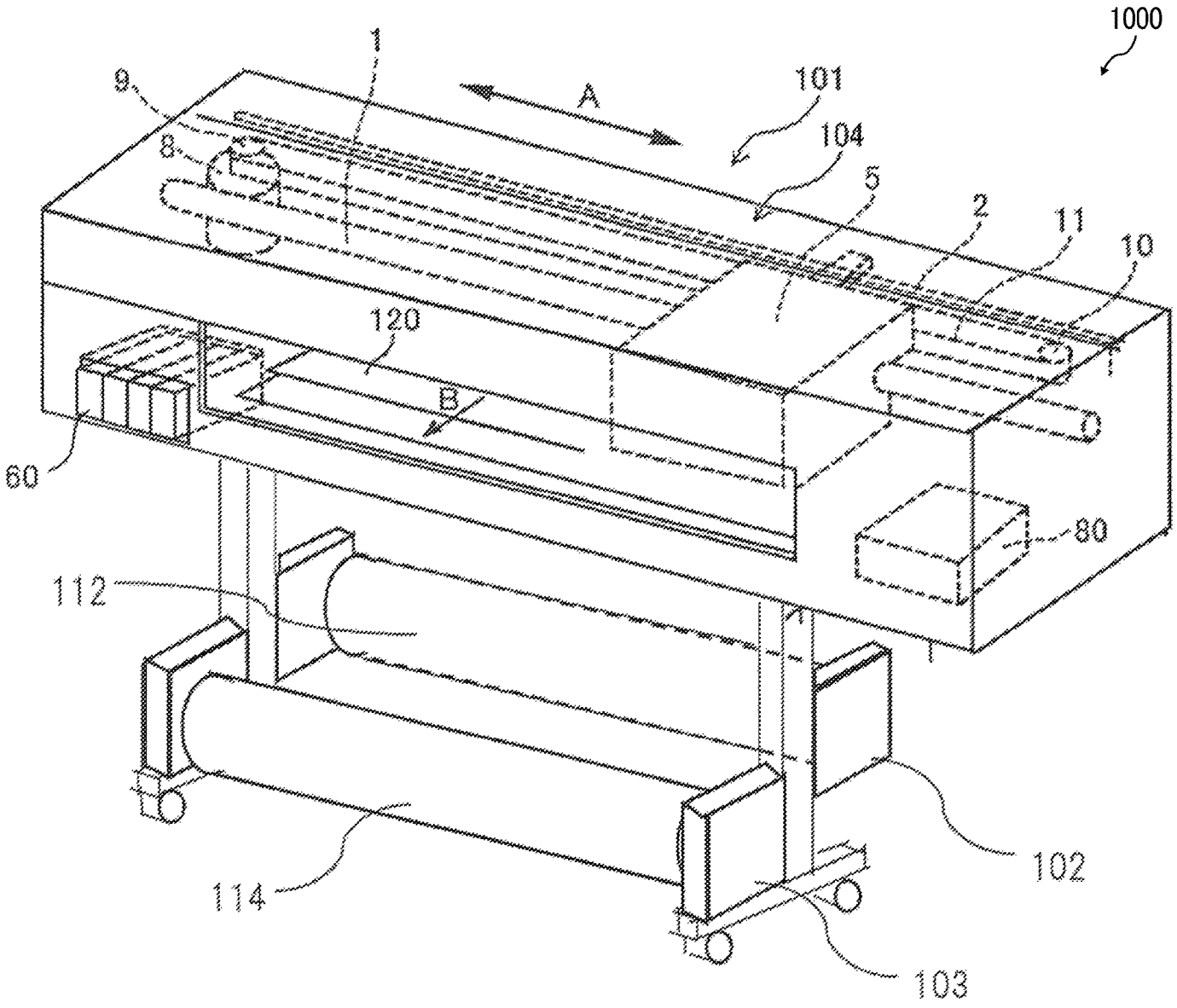
FIG. 1 is a perspective view illustrating a schematic configuration of an image forming apparatus according to an embodiment of this disclosure, to which a tension controller according to an embodiment of this disclosure is applied, viewed from a diagonally upward direction.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of a tension controller, a medium conveying device incorporating the tension controller, and an image forming apparatus incorporating the medium conveying device, according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an example applicable to a tension roller, a medium conveying device incorporating the tension controller, and an image forming apparatus incorporating the medium conveying device.

It is to be noted that elements (for example, mechanical parts and components) having the same functions and shapes are denoted by the same reference numerals throughout the specification and redundant descriptions are omitted.

Embodiment

Figure 2:
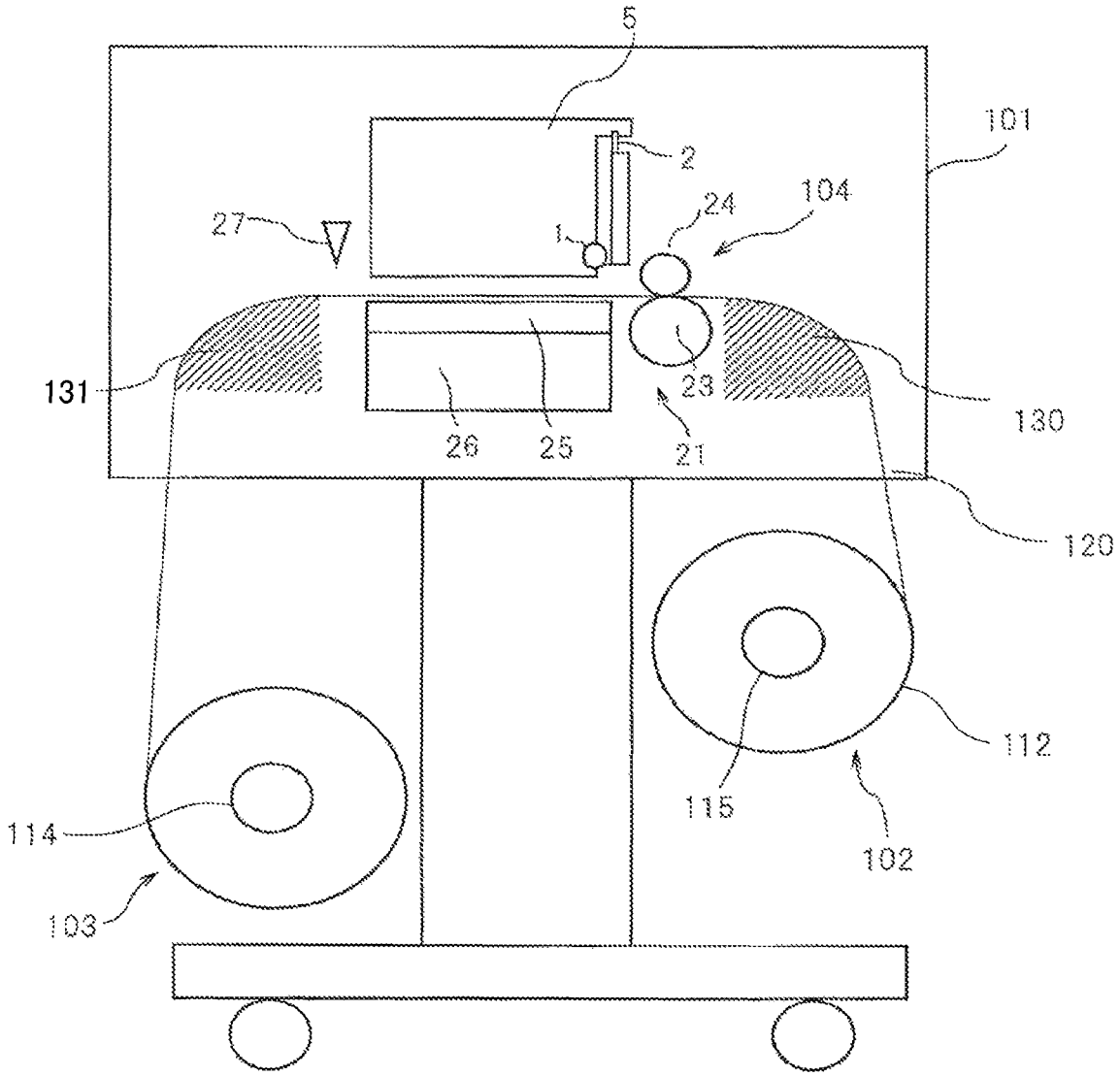
FIG. 2 is a side view illustrating the image forming apparatus of FIG. 1.
Figure 3:
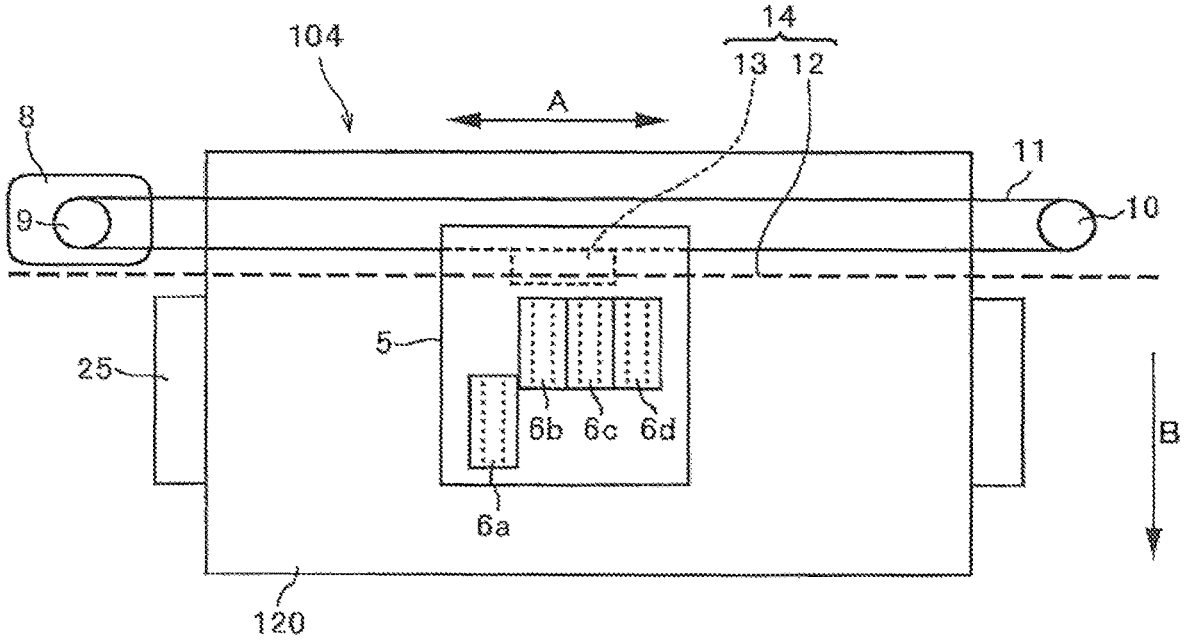
FIG. 3 is a plan view illustrating an image forming device provided to the image forming apparatus of FIG. 1.

FIG. 1 is a perspective view illustrating a schematic configuration of an image forming apparatus 1000 according to an embodiment of this disclosure, to which a tension controller according to an embodiment of this disclosure is applied, viewed from a diagonally upward direction. FIG. 2 is a side view illustrating the image forming apparatus 1000 of FIG. 1. FIG. 3 is a plan view illustrating an image forming device 104 provided to the image forming apparatus 1000 of FIG. 1.

The image forming apparatus 1000 may be a copier, a facsimile machine, a printer, a multifunction peripheral or a multifunction printer (MFP) having at least one of copying, printing, scanning, facsimile, and plotter functions, or the like. According to the present example, the image forming apparatus 1000 is an inkjet image forming apparatus that forms images on recording media by discharging ink or liquid droplets.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

Referring to FIG. 1, the image forming apparatus 1000 includes an apparatus body 101, a medium supplying device arranged below the apparatus body 101 to supply a conveyance target medium that is wound in a roll shape as a medium, a medium take-up device also arranged below the apparatus body 101 to take up the conveyance target medium. The conveyance target medium includes a sheet that can be wound in a roll shape, for example, plain paper, coated sheet, thick paper, OHP sheet, plastic film, prepreg, and silver foil. The configuration according to this disclosure employs a roll sheet as a conveyance target medium. In this case, the medium supplying device corresponds to a sheet feeding device 102 and a sheet take-up device 103. The sheet feeding device 102 includes a roll 112 having a hollow shaft 115 around which a sheet (the conveyance target medium) is wound. The sheet take-up device 103 includes a hollow shaft 115 that takes up the sheet. In this configuration, the sheet feeding device 102 and the sheet take-up device 103 are not formed with apparatus body 101 in a single unit but are formed as parts different from the apparatus body 101.

The sheet feeding device 102 that functions as a medium supplying device feeds and supplies a roll sheet 120 to an inner side of apparatus body 101.

The image forming device 104 is disposed inside the apparatus body 101 to form an image on the roll sheet 120 that is fed in a sheet conveying direction indicated by arrow B in FIG. 1.

The sheet take-up device 103 that functions as a medium take-up device takes up the roll sheet 120 having an image formed on the surface of the roll sheet 120.

The image forming device 104 includes a guide rod 1 and a guide stay 2, both of which function as guides. The guide rod 1 and the guide stay 2 are disposed between side plates disposed on both sides of the image forming device 104. A carriage 5 is supported by the guide rod 1 and the guide stay 2 to move in the main scanning direction indicated by arrow A in FIG. 1.

A main scanning motor 8 that functions as a drive source is disposed on one end of the image forming device 104 in the main scanning direction. The main scanning motor 8 drives the carriage 5 to move reciprocally.

A drive pulley 9 that is driven by the main scanning motor 8 is disposed on the same side of the main scanning motor 8 and a driven pulley 10 is disposed on an opposite side to the drive pulley 9 in the main scanning direction. A timing belt 11 is wound around the drive pulley 9 and the driven pulley 10.

A belt holding portion of the carriage 5 is fixed to the timing belt 11. As the main scanning motor 8 drives, the carriage 5 moves reciprocally in the main scanning direction.

Multiple print heads, in the present embodiment, four print heads 6*a*, 6*b*, 6*c*, and 6*d* are provided to the carriage 5. Each of the print heads 6*a*, 6*b*, 6*c*, and 6*d* integrally includes a liquid discharging head and a head tank that supplies liquid to the liquid discharging head. Here, the print head 6*a* is disposed different from the print heads 6*b*, 6*c*, and 6*d* by an amount by one head (in other words, by one nozzle row) in the sub-scanning direction that is a direction perpendicular to the main scanning direction. Further, the print heads 6*a*, 6*b*, 6*c*, and 6*d* includes nozzle rows in the sub-scanning direction. The nozzle row ejects ink toward a downward direction as a droplet discharging direction.

In addition, each of the print heads 6*a*, 6*b*, 6*c*, and 6*d* has two nozzle rows. The print head 6*a* and the print head 6*b* discharge liquid droplets of the same color, which is black, from each nozzle row. The print head 6*c* discharges liquid droplets of cyan from one of the two nozzle rows and does not use the other of the two nozzle rows. The print head 6*d* discharges liquid droplets of yellow from one of the two nozzle rows and does not use the other of the two nozzle rows.

According to this configuration, the print heads 6*a* and 6*b* are used to form a monochrome image having a width of two print heads in one scanning in the main scanning direction and the print heads 6*a*, 6*b*, 6*c*, and 6*d* are used to form a color image. It is to be noted that the configuration of the print heads is not limited to this configuration but may be a configuration in which multiple print heads are aligned along the main scanning direction.

In addition, an encoder sheet 12 is disposed along the moving direction of the carriage 5, and an encoder sensor 13 is provided to the carriage 5 to read the encoder sheet 12. The encoder sheet 12 and the encoder sensor 13 form a linear encoder 14 to detect a position and a speed of the carriage 5 based on the output of the linear encoder 14.

The roll sheet 120 is fed from the sheet feeding device 102 to a recording area of the carriage 5 in the main scanning direction. Then, a sheet conveying device 21 intermittently conveys the roll sheet 120 in the sub-scanning direction that is a direction perpendicular to the main scanning direction of the carriage 5.

Ink cartridges 60 that function as main tanks that is replaceable and is attached to the apparatus body 101 supply respective color inks from respective head tanks of the print heads 6*a*, 6*b*, 6*c*, and 6*d* via respective supply tubes. Further, a maintenance unit 80 is disposed one end of the apparatus body 101 in the main scanning direction of the carriage 5, near a sheet conveyance guide 25. The maintenance unit 80 maintains and recovers the performance of the print heads 6*a*, 6*b*, 6*c*, and 6*d*.

The sheet conveying device 21 illustrated in FIG. 2 includes a conveying roller 23 and a pressing roller 24. The conveying roller 23 conveys the roll sheet 120 that is fed from the sheet feeding device 102. The pressing roller 24 is disposed opposite the conveying roller 23. The sheet conveyance guide 25 and a suction fan 26 are disposed downstream from the conveying roller 23 in the sheet conveying direction. The sheet conveyance guide 25 has multiple suction holes. The suction fan 26 functions as a suction body to suck air through the multiple suction holes of the sheet conveyance guide 25. In addition, a cutter 27 is disposed downstream from the sheet conveying device 21 in the sheet conveying direction. The cutter 27 cuts the roll sheet 120 on which an image is formed by the print heads 6*a*, 6*b*, 6*c*, and 6*d*, to a predetermined length.

The roll 112 of the sheet feeding device 102 is a roller having the hollow shaft 115, such as a paper tube that is a core member, around which the roll sheet 120 in a long sheet shape is wound. The roll 112 is attachable to the hollow shaft 115 even whether the terminal end of the roll sheet 120 is fixed to the hollow shaft 115 with adhesive such as glue or the terminal end of the roll sheet 120 is not fixed to the hollow shaft 115.

As illustrated in FIG. 2, a guide 130 and a sheet ejecting guide 131 are disposed on the apparatus body side of the image forming apparatus 1000. The guide 130 guides the roll sheet 120 that is fed from the roll 112 of the sheet feeding device 102. The sheet ejecting guide 131 guides the roll sheet 120 at the downstream side of the sheet conveyance guide 25 after the roll sheet 120 is sucked by the multiple suction holes of the sheet conveyance guide 25 and the suction fan 26. The sheet take-up device 103 includes a hollow shaft 114 such as a paper pipe which is a core member. The leading end of the roll sheet 120 is adhered to the hollow shaft 114 with adhesive such as a tape.

In the image forming apparatus 1000 having the above-described configuration, the carriage 5 moves in the main scanning direction when forming an image and the sheet conveying device 21 intermittently conveys the roll sheet 120 that is fed from the roll 112 of the sheet feeding device 102 and is guided along the guide 130. Then, the print heads 6*a*, 6*b*, 6*c*, and 6*d* are driven to discharge liquid droplets according to image data (print information). Accordingly, an image is formed on the roll sheet 120. The roll sheet 120 on which the image is formed is guided to the sheet ejecting guide 131 and is taken up by the hollow shaft 114 of the sheet take-up device 103. The roll sheet 120 on the conveying roller 23 is conveyed while being applied with a tension force from both the sheet feeding device 102 and the sheet take-up device 103. The tension force applied by the sheet feeding device 102 and the tension force applied by the sheet take-up device 103 affect on the accuracy in conveyance of the roll sheet 120.

It is to be noted that the sheet feeding device 102 is a medium feeding device that is a device capable of feeding not only the roll sheet 120 but also other conveyance target medium and is provided with a tension controller. In this case, the device is referred to as a medium tension controller. Similarly, the sheet take-up device 103 may be a device having the same function as the above-described sheet feeding device 102. Further, the configuration in which the tension controller is disposed in at least one of the sheet feeding device 102 and the sheet take-up device 103 may also be referred to as a medium conveying device.

As described above, the image forming apparatus 1000 according to the present embodiment includes the sheet feeding device 102 that retains the roll 112. However, any other configuration may be applied to an image forming apparatus according to this disclosure. For example, a configuration in which a liquid discharging apparatus that is provided with the sheet feeding device 102 that retains the roll 112 may also be applied to this disclosure. The term "liquid discharge apparatus" used herein is an apparatus including the liquid discharge head or the liquid discharge device to discharge liquid by driving the liquid discharge head. The liquid discharge apparatus may be, for example, an apparatus capable of discharging liquid to a material to which liquid can adhere and an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged. The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object. The "liquid discharge apparatus" is not limited to an apparatus to discharge liquid to visualize meaningful images, such as letters or figures. For example, the liquid discharge apparatus includes an apparatus to form meaningless images, such as meaningless patterns, or fabricate three-dimensional images.

The above-described term "material onto which liquid adheres" denotes, for example, a material or a medium onto which liquid is adhered at least temporarily, a material or a medium onto which liquid is adhered and fixed, or a material or a medium onto which liquid is adhered and into which the liquid permeates. Examples of the "material onto which liquid adheres" include recording media such as a paper sheet, recording paper, and a recording sheet of paper, film, and cloth, electronic components such as an electronic substrate and a piezoelectric element, and media such as a powder layer, an organ model, and a testing cell. The "material onto which liquid adheres" includes any material on which liquid adheres unless particularly limited.

The above-mentioned "material onto which liquid adheres" may be any material as long as liquid can temporarily adhere such as paper, thread, fiber, cloth, leather, metal, plastic, glass, wood, ceramics, or the like. The liquid includes ink, treatment solution, a DNA sample, a resist pattern material, a binding agent, a modeling solution, or a solution and a dispersion solution containing amino acid, protein, and calcium.

The "liquid discharge apparatus" may be an apparatus to relatively move the liquid discharge head and a material on which liquid can be adhered. However, the liquid discharge apparatus is not limited to such an apparatus. For example, the "liquid discharge apparatus" may be a serial head apparatus that moves the liquid discharge head, a line head apparatus that does not move the liquid discharge head, or the like.

Examples of the "liquid discharge apparatus" further include a treatment liquid coating apparatus to discharge the treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials. Further, there is an injection granulation apparatus for spraying a composition liquid in which raw materials are dispersed in a solution through a nozzle to granulate fine particles of the raw material.

The above-described "liquid discharge device" is an assembly of parts relating to liquid discharge. The term "liquid discharge device" represents a structure including the liquid discharge head and a functional part(s) or mechanism combined to the liquid discharge head. For example, the "liquid discharge device" may include a combination of the liquid discharge head with at least one of a head tank, a carriage, a supply-circulation mechanism, a maintenance unit, and a main scan moving unit. Examples of the integrated unit include a combination in which the head and one or more functional parts and devices are secured to each other through, e.g., fastening, bonding, or engaging, and a combination in which one of the head and the functional parts and devices is movably held by another. Further, the head, the functional parts, and the mechanism may be configured to be detachable from each other.

Examples of the liquid discharge device further include a liquid discharge head integrated with a supply-circulation mechanism. In this case, the liquid discharge head and the supply-circulation mechanism may be connected to each other with a tube. Furthermore, a filter unit may be disposed between the supply-circulation mechanism and the liquid discharge head. The liquid discharge head and the carriage may form the "liquid discharge device" as a single unit.

In still another example, the liquid discharge device includes the liquid discharge head movably held by a guide that forms part of a main scan moving unit, so that the head and the main scan moving unit form a single unit. For example, the "liquid discharge device" may include a combination of the liquid discharge head with a carriage and a main scan moving unit. The main scan moving unit may be a guide alone.

In still another example, the cap that forms part of the maintenance unit is secured to the carriage mounting the liquid discharge head so that the liquid discharge head, the carriage, and the maintenance unit form a single unit to form the liquid discharge device. Examples of the liquid discharge device further include a liquid discharge head integrated with a supply device in such a manner that a head tank or a channel member is mounted on the liquid discharge head and a tube is connected to the liquid discharge head. It is to be noted that the supply device may include a tube(s) alone or a loading unit alone.

Further, a source for generating pressure of the liquid discharging head is not limited to a specific device. For example, a piezoelectric actuator (i.e., a laminated piezoelectric element) may be used. Other than the piezoelectric actuator, a thermal actuator that employs a thermoelectric conversion element, such as a heating resistor, and an electrostatic actuator including a diaphragm and opposed electrodes may be used. The terms "image formation", "recording", "printing", "image printing", and "fabricating" used herein may be used synonymously with each other.

Figure 4:
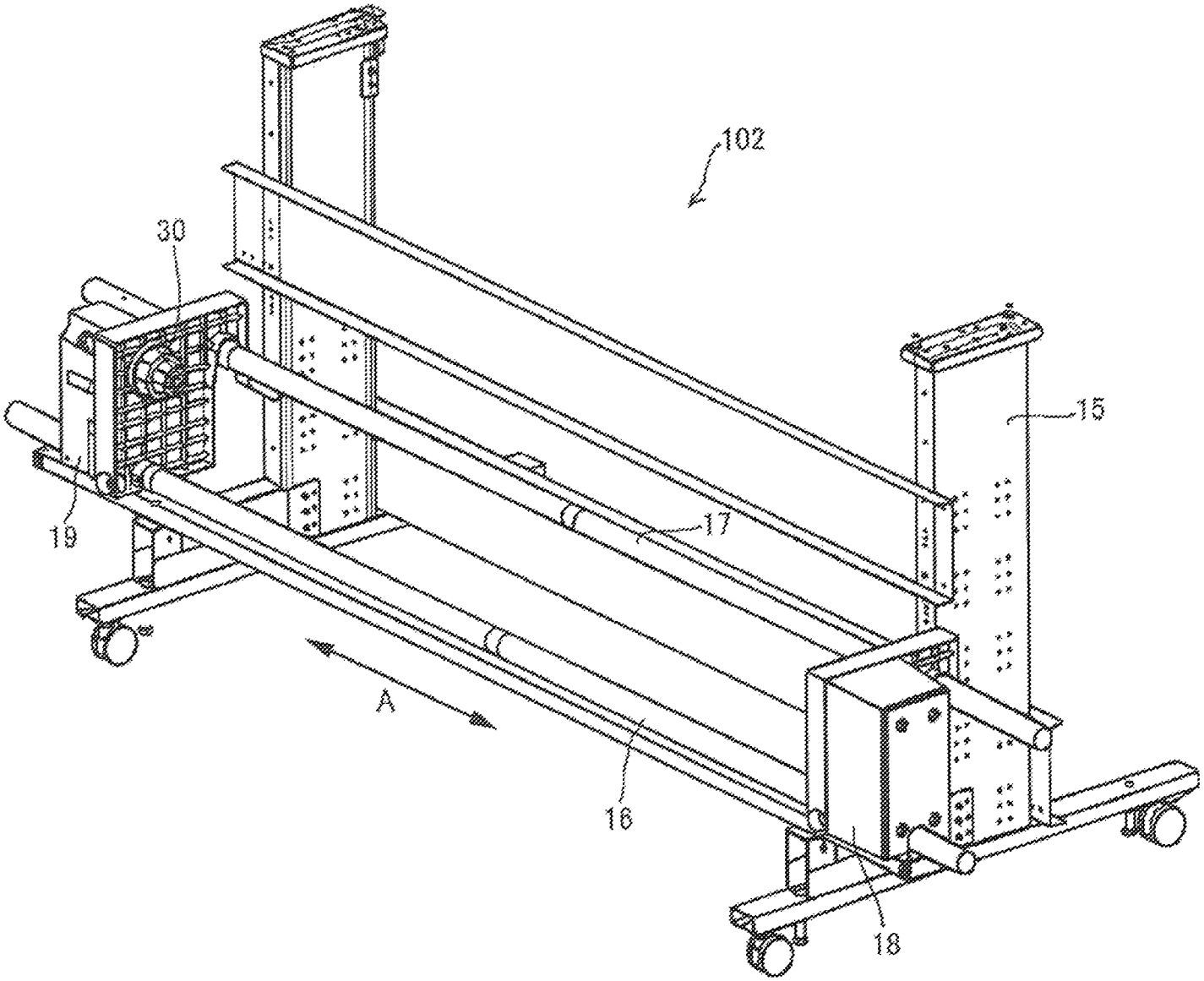
FIG. 4 is a perspective view illustrating an appearance configuration of a sheet conveying device provided to the image forming apparatus of FIG. 1, viewed from the diagonally upward direction.

FIG. 4 is a perspective view illustrating an appearance configuration of the sheet feeding device 102 provided to the image forming apparatus 1000 of FIG. 1, viewed from the diagonally upward direction.

As illustrated in FIG. 4, the sheet feeding device 102 includes a stand body 15, a first guide 16, and a second guide 17. The first guide 16 and the second guide 17 are attached to the stand body 15 and are disposed parallel to each other. Both the first guide 16 and the second guide 17 extend in the longitudinal direction of the roll 112. The longitudinal direction of the roll 112 is indicated by arrow A in FIG. 4.

A first retaining unit 18 is disposed at one end of the first guide 16 and one end of the second guide 17 that is the same end as the one end of the first guide 16. A second retaining unit 19 is disposed at the other end of the first guide 16 and the other end of the second guide 17 that is the same end as the other end of the first guide 16. The first retaining unit 18 and the second retaining unit 19 are disposed facing each other and supported by the first guide 16 and the second guide 17 to be movable in the direction A. Each of the first retaining unit 18 and the second retaining unit 19 includes a roll retaining device 30.

The first retaining unit 18 and the second retaining unit 19 regard the first guide 16 as a primary reference and the second guide 17 as a secondary reference. The roll retaining device 30 of the first retaining unit 18 and the roll retaining device 30 of the second retaining unit 19 are disposed immediately above the first guide 16. The first retaining unit 18 includes a drive device to rotate the roll retaining device 30. By contrast, the second retaining unit 19 does not include a drive device. Each of the first retaining unit 18 and the second retaining unit 19 fits the roll retaining device 30 into the hollow shaft 115 of the roll 112 to retain the roll 112.

As described above, the conveyance target medium corresponds to the roll sheet 120 in the present embodiment. As the roll sheet 120 is being conveyed, the tension force is applied by the sheet feeding device 102 and the tension force is also applied by the sheet take-up device 103, and the tension forces affect on the accuracy in conveyance of the roll sheet 120. In particular, the tension force of the sheet feeding device 102 to be applied to the roll sheet 120 is to be considered. At this time, however, it is difficult to stabilize a load to be applied to a motor of the drive device.

In order to address this inconvenience, the image forming apparatus 1000 according to this disclosure provides a constant load to the motor and controls the tension force.

A description is given of a case in which a tension controller is provided to the sheet feeding device 102.

Figure 5:
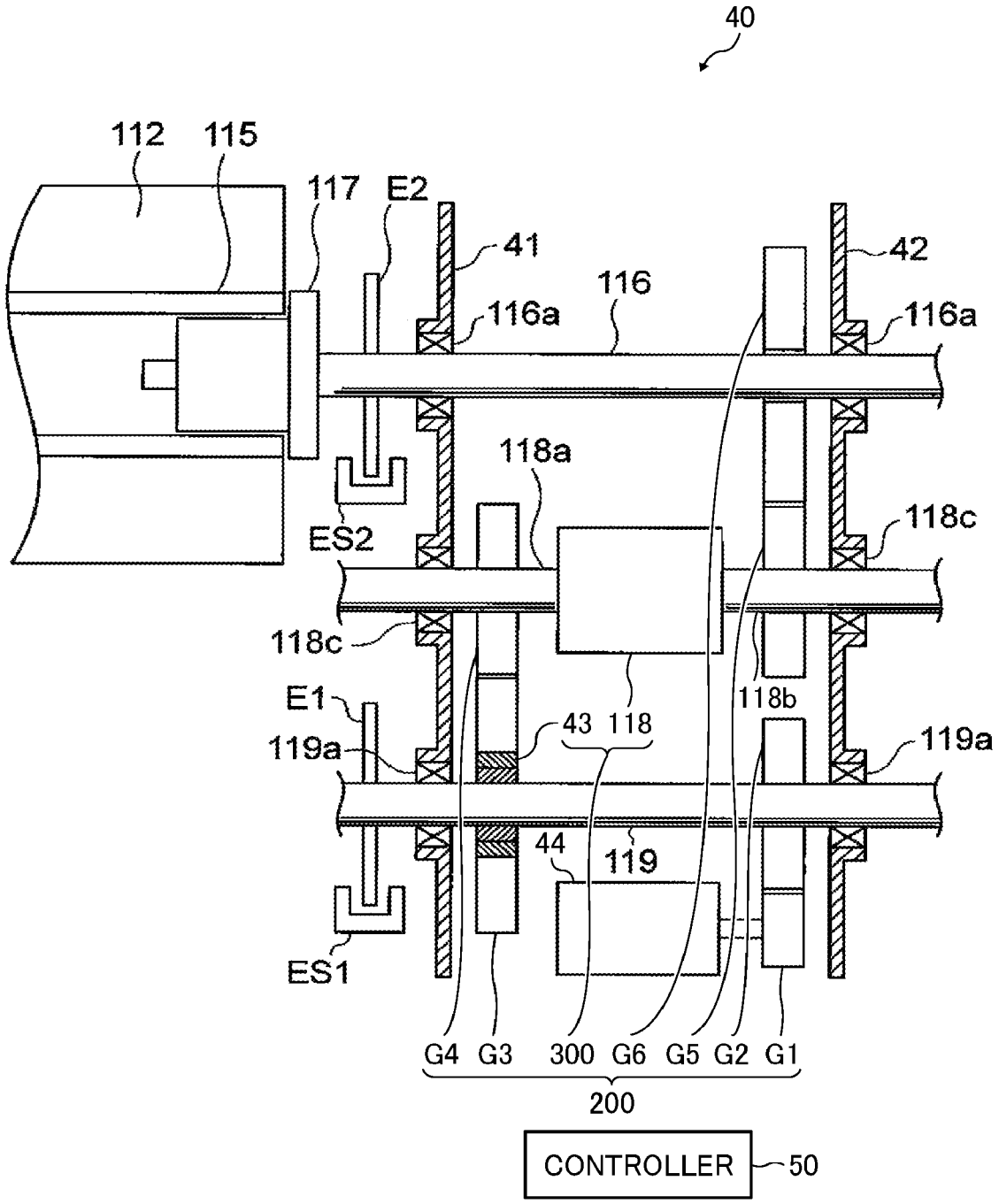
FIG. 5 is a diagram illustrating a detailed configuration of a sheet conveyance drive device that functions as a tension controller of the medium conveying device of FIG. 4.

FIG. 5 is a diagram illustrating a detailed configuration of a sheet conveyance drive device 40 that functions as a tension controller of the sheet feeding device 102 described above.

As illustrated in FIG. 5, the sheet conveyance drive device 40 includes a motor 44 and a drive transmission device 200. The motor 44 functions as a drive device to rotate a drive shaft. The drive transmission device 200 is provided between support plates 41 and 42 that transmit a rotation driving force of the drive shaft of the motor 44 to rotate the hollow shaft 115 of the roll 112. The drive transmission device 200 includes a tension applying mechanism 300 provided between the drive shaft of the motor 44 and a rotary shaft 116 supported by a bearing 116*a* to transmit the rotation driving force to the hollow shaft 115 of the roll 112.

The tension applying mechanism 300 includes a torque limiter 43 mounted on a rotary shaft 119 that is supported by a bearing 119*a* to which the rotation driving force is transmitted from a gear G1 of the drive shaft of the motor 44 via a gear G2 on the rotary shaft 119. Further, the tension applying mechanism 300 further includes a variable speed reducing mechanism 118 includes an input shaft 118*a* and an output shaft 118*b* that are supported by respective bearings 118*c*. In the tension applying mechanism 300 having such a configuration, the variable speed reducing mechanism 118 changes the speed reduction ratio between the rotary shaft 116 and the torque limiter 43 to apply a tension force to the roll sheet 120 of the roll 112. In addition, the drive transmission device 200 includes a gear G3 that is mounted on a circumferential surface of the torque limiter 43, a gear G4 that is mounted on the input shaft 118*a* of the variable speed reducing mechanism 118, a gear G5 that is mounted on the output shaft 118*b*, and a gear G6 that is mounted on the rotary shaft 116.

The sheet conveyance drive device 40 includes an encoder E1 and an encoder sensor ES1. The encoder E1 is a rotary encoder that is mounted on the rotary shaft 119. The encoder E1 functions as a first detector to detect a direction of rotation of the rotary shaft 119 and an amount of rotation of the rotary shaft 119. The encoder sensor ES1 is disposed in the vicinity of the encoder E1. The sheet conveyance drive device 40 further includes an encoder E2 and an encoder sensor ES2. The encoder E2 is a rotary encoder that is mounted on the rotary shaft 116. The encoder E2 functions as a second detector to detect a direction of rotation of the rotary shaft 116 and an amount of rotation of the rotary shaft 116. The encoder sensor ES2 is disposed in the vicinity of the encoder E2.

The sheet conveyance drive device 40 further includes a controller 50. The controller 50 functions as circuitry to control the motor 44 according to a detection result of each of the encoder E1 and the encoder E2. By so doing, the controller 50 applies a tension force to the roll sheet 120 of the roll 112 via the tension applying mechanism 300. The controller 50 determines the speed reduction ratio of the tension applying mechanism 300 based on the differential value of the amount of rotation of the rotary shaft 119 in the detection result of the encoder E1 and the amount of rotation of the rotary shaft 116 in the detection result of the encoder E2, and then reflects the determination result when controlling the motor 44. In addition, the sheet conveyance drive device 40 further includes a flange 117 that is mounted on the hollow shaft 115 of the roll 112 to retain the roll 112. The flange 117 corresponds to the roll retaining device 30 described above.

Now, a description is given of detailed functions of the sheet conveyance drive device 40.

The motor 44 is a drive source to rotate the roll 112 and is fixed to one of the support plate 41 and the support plate 42. When the drive shaft of the motor 44 is driven and rotated, as the rotation driving force is transmitted from the gear G1 to the gear G2 mounted on the rotary shaft 119, the rotary shaft 119 is rotated with the gear G2, thus the rotation driving force is transmitted. Since the torque limiter 43 and the gear G3 are mounted on the rotary shaft 119, when a torque equal to or greater than the slip torque of the torque limiter 43 is applied, the gear G3 and the rotary shaft 119 are relatively rotated. At this time, the encoder E1 is rotated, and the encoder sensor ES1 detects the rotation of the encoder E1. The detection result of the encoder sensor ES1 is sent to the controller 50. Consequently, the controller 50 controls the motor 44 in consideration of the speed reduction ratio of the tension applying mechanism 300. The rotary shaft 119 is supported by bearings 116*a*, one of which is mounted on the support plate 41 and the other of which is mounted on the support plate 42.

The variable speed reducing mechanism 118 includes an input shaft 118*a* and an output shaft 118*b*. The input shaft 118*a* transmits a rotation driving force transmitted from the motor side. The output shaft 118*b* transmits the rotation driving force to the roller side. Specifically, the gear G4 is mounted on the input shaft 118*a* so as not to be rotated relative to the input shaft 118*a*. According to this configuration, the rotation driving force is transmitted from the gear G3 to the input shaft 118*a* via the gear G4. The gear G5 is mounted on the output shaft 118*b* so as not to be rotated relative to the output shaft 118*b*. According to this configuration, the rotation driving force is transmitted from the output shaft 118*b* to the gear G5. The input shaft 118*a* is supported by a bearing 118*c* that is attached to and supported by the support plate 41. Similarly, the output shaft 118*b* is supported by another bearing 118*c* that is attached to and supported by the support plate 42.

The gear G6 is mounted on the rotary shaft 116 so as not to be rotated relative to the rotary shaft 116. According to this configuration, the rotation driving force is transmitted from the gear G5 to the rotary shaft 116 via the gear G6. At this time, the encoder E2 is rotated, and the encoder sensor ES2 detects the rotation of the encoder E2. Since the detection result of the encoder sensor ES2 is also sent to the controller 50, the controller 50 controls the motor 44 in consideration of the amount of rotations (i.e., the number of rotations) of the hollow shaft 115 of the roll 112. The rotary shaft 116 is supported by bearings 116*a*, one of which is mounted on the support plate 41 and the other of which is mounted on the support plate 42.

The controller 50 compares the detection result of an encoder (i.e., the encoder E1) on the number of rotations of the input side of the variable speed reducing mechanism 118 and the detection result of another encoder (i.e., the encoder E2) on the number of rotations of the output side of the variable speed reducing mechanism 118. By so doing, the controller 50 determines the speed reduction ratio of the tension applying mechanism 300 and reflects the determination result when controlling the motor 44. As a result, a constant load is applied to the motor 44, and the function of low-cost tension control is obtained. It is to be noted that, as described above, the sheet conveyance drive device 40 according to the present embodiment of this disclosure employs the gears G1, G2, G3, G4, G5, and G6. However, the configuration that is applicable to this disclosure is not limited to the above-described configuration. For example, a pulley and a belt may be employed instead of the gears G1 through G6.

Figure 6A:
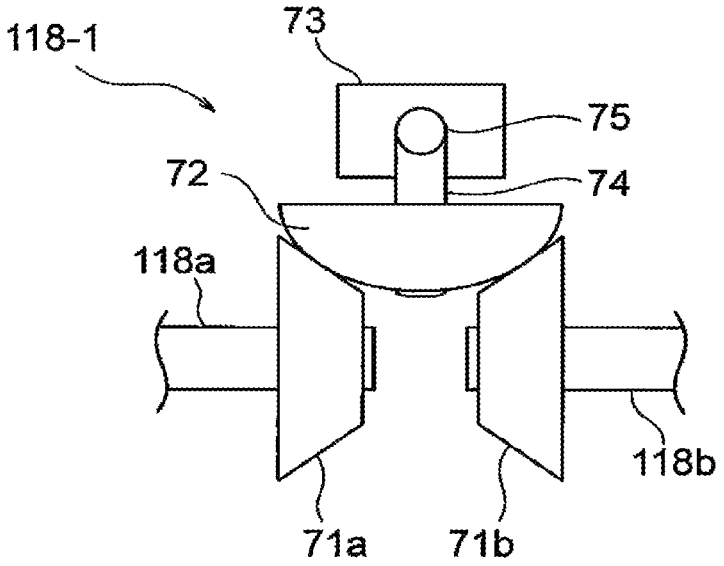
FIG. 6A is a front view illustrating a variable speed reducing mechanism applicable to the media conveyance drive device of FIG. 5, with no change in speed reduction.
Figure 6B:
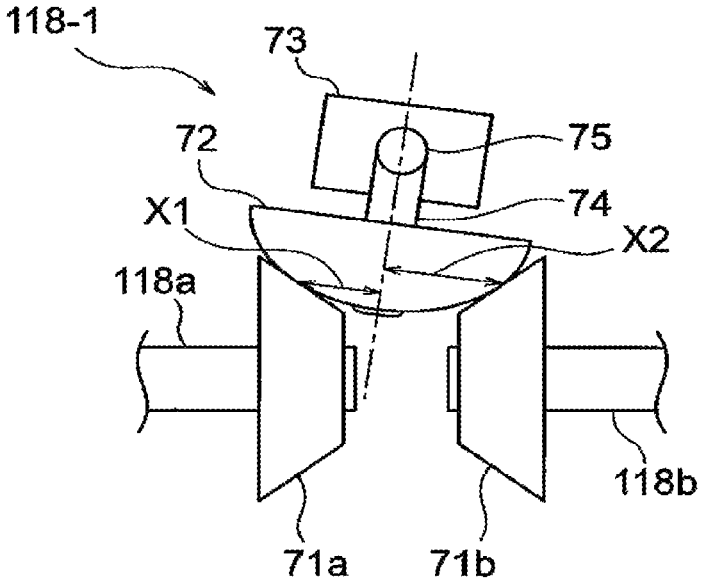
FIG. 6B is a front view illustrating the variable speed reducing mechanism provided to the media conveyance drive device of FIG. 5, with a change in speed reduction.

FIG. 6A is a front view illustrating an example of the variable speed reducing mechanism 118, which is a variable speed reducing mechanism 118-1 with no change in speed reduction. FIG. 6B is a front view illustrating the variable speed reducing mechanism 118-1 with a change in speed reduction.

Referring to FIG. 6A, the variable speed reducing mechanism 118-1 includes an input side conical roller 71*a*, an output side conical roller 71*b*, a semi-sphere-shaped roller 72, and a retaining member 73 that is formed by coupled by a first shaft 74 and a second shaft 75. The input side conical roller 71*a* is mounted on an end of the input shaft 118*a* and the output side conical roller 71*b* is mounted on an end of the output shaft 118*b*. The input side conical roller 71*a* and the output side conical roller 71*b* are coaxially disposed with each side having a smaller diameter facing each other.

The first shaft 74 is held by the retaining member 73. The semi-sphere-shaped roller 72 is supported to be rotatable about the first shaft 74, with the axis of the first shaft 74 passing the center of the curved surface of the semi-sphere-shaped roller 72 and extending in the direction vertical to the axis of the input shaft 118*a* and the axis of the output shaft 118*b*. The second shaft 75 is coupled with the first shaft 74 in the retaining member 73. The semi-sphere-shaped roller 72 is supported to be rotatable about the second shaft 75, with the axis of the second shaft 75 passing the center of the curved surface of the semi-sphere-shaped roller 72 and extending in the vertical direction to the axis of the first shaft 74. Further, the semi-sphere-shaped roller 72 is disposed in contact with the side face of the input side conical roller 71*a* and the side face of the output side conical roller 71*b*.

In the variable speed reducing mechanism 118-1, rotation of the input shaft 118*a* is transmitted from the input side conical roller 71*a* to rotation about the axial center of the first shaft 74 that is held by the retaining member 73 that presses the semi-sphere-shaped roller 72. Thereafter, the rotation about the axial center of the first shaft 74 is transmitted to the semi-sphere-shaped roller 72 that is rotated about the second shaft 75 that is held by the retaining member 73, and to rotation of the output shaft 118*b* via the output side conical roller 71*b*, by a frictional force generated between the members.

In other words, each of the retaining member 73 and the first shaft 74 and the second shaft 75 that are held by the retaining member 73 functions as a pressing body to press the semi-sphere-shaped roller 72 toward the side face of the input side conical roller 71*a* and the side face of the output side conical roller 71*b* by the own weights. FIG. 6A illustrates a state in which, due to the above-described transmission, there is no difference between the distance from the axial center of the first shaft 74 to the contact point (the contact position) of the input side conical roller 71*a* and the distance from the axial center of the first shaft 74 to the contact point (the contact position) of the output side conical roller 71*b* and no change occurs in speed reduction.

By contrast, FIG. 6B illustrates a state in which a change in speed reduction is caused by the above-described transmission. In this state, in a case in which the semi-sphere-shaped roller 72 is rotated about the second shaft 75, a contact point (a contact position) at which the semi-sphere-shaped roller 72 contacts the input side conical roller 71*a* and a contact point (a contact position) at which the semi-sphere-shaped roller 72 contacts the output side conical roller 71*b* are changed, resulting in a relatively large difference between the distance from the axial center of the first shaft 74 to the contact point of the input side conical roller 71*a* and the distance from the axial center of the first shaft 74 to the contact point of the output side conical roller 71*b*. Specifically, as illustrated in FIG. 6B, the difference is generated between a distance X1 from the axial center of the first shaft 74 to the contact point of the input side conical roller 71*a* and a distance X2 from the axial center of the first shaft 74 to the contact point of the output side conical roller 71*b*, and therefore a change in speed reduction is caused in the transmission.

Due to such a difference between the distance X1 and the distance X2, the number of rotations to be transmitted from the input side to the output side and the amount of torque to be transmitted from the input side to the output side are changed, and therefore the speed reduction ratio is varied continuously (steplessly). According to this configuration, the load to be applied to the motor 44 is controlled accurately to a constant load.

Figure 7:
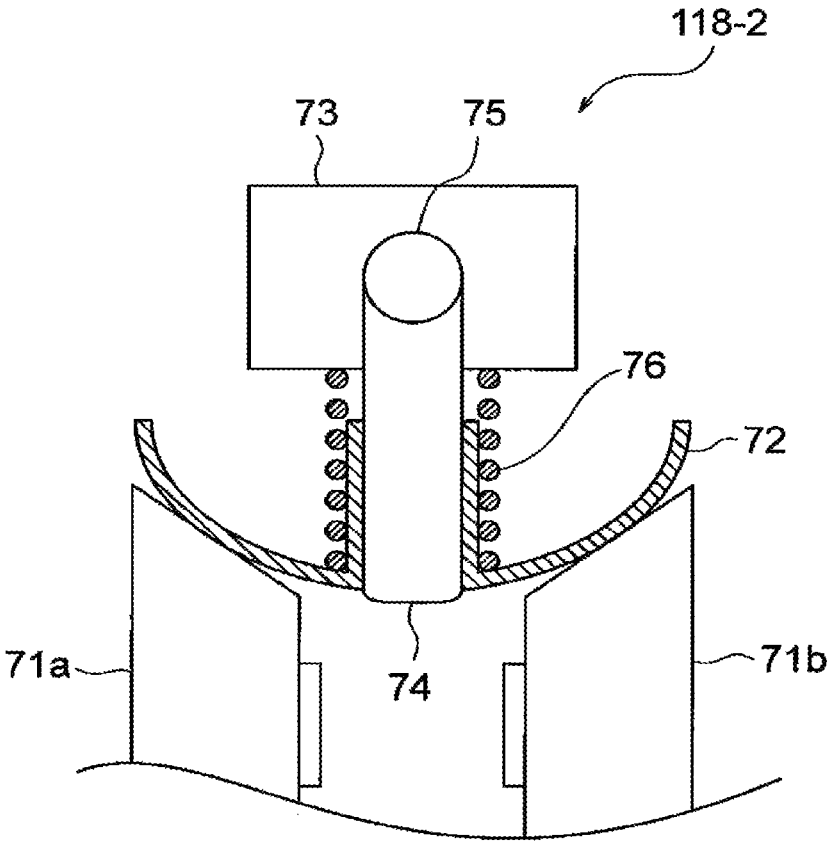
FIG. 7 is a cross-sectional view illustrating another variable speed reducing mechanism applicable to the media conveyance drive device of FIG. 5, partially enlarged.

FIG. 7 is a cross-sectional view illustrating another variable speed reducing mechanism, which is a variable speed reducing mechanism 118-2, with the semi-sphere-shaped roller 72 being partially enlarged.

Different from the variable speed reducing mechanism 118-1 of FIGS. 6A and 6B, the variable speed reducing mechanism 118-2 of FIG. 7 includes an elastic member 76 such as a spring that is disposed around the first shaft 74 and is supported by the first shaft 74. The elastic member 76 that functions as an elastic body has one end that is in contact with the semi-sphere-shaped roller 72 and an opposed end that is in contact with the retaining member 73. In addition, the semi-sphere-shaped roller 72 in the variable speed reducing mechanism 118-2 is supported to be slidable in the axial direction relative to the first shaft 74.

According to the variable speed reducing mechanism 118-2, the semi-sphere-shaped roller 72 is biased by the elastic member 76 in the axial direction of the first shaft 74 toward the spherical center of the semi-sphere-shaped roller 72. Due to the biasing of the semi-sphere-shaped roller 72 by the elastic member 76, the pressing force of the semi-sphere-shaped roller 72 and the input side conical roller 71*a* and the pressing force of the semi-sphere-shaped roller 72 and the output side conical roller 71*b* increase, and therefore the respective frictional forces also increase, so that the driving force is stably transmitted. According to this configuration, the load to be applied to the motor 44 here is controlled more accurately to a constant load. It is to be noted that, since the elastic member 76 presses (biases) the semi-sphere-shaped roller 72 to the side face of the input side conical roller 71*a* and the side face of the output side conical roller 71*b*, the elastic member 76 may also function as a pressing body.

Figure 8A:
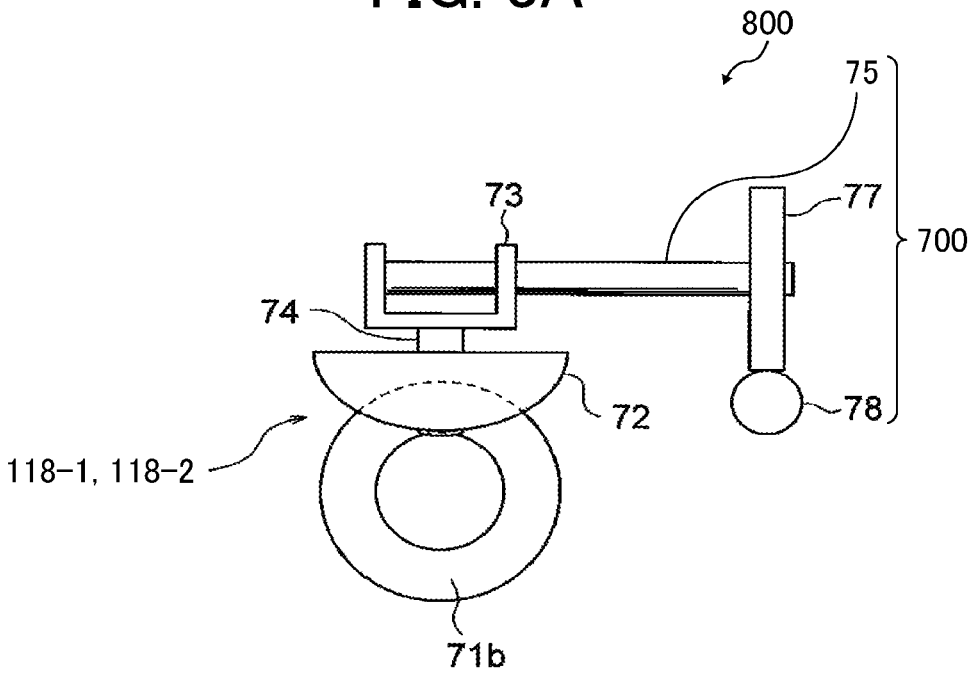
FIG. 8A is a side view illustrating a rotatable driving mechanism to a semi-sphere-shaped roller of the variable speed reducing mechanism applicable to any configuration of FIGS. 6A, 6B, and 7.
Figure 8B:
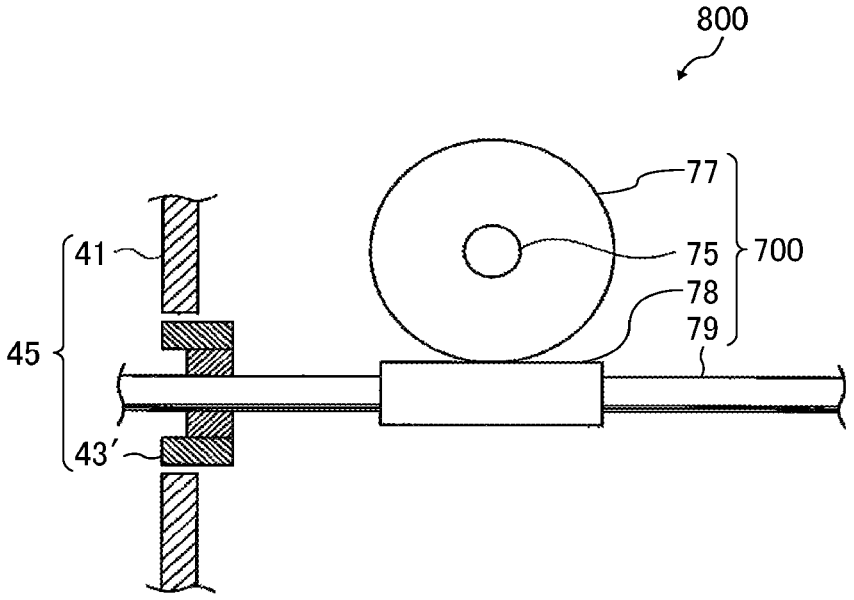
FIG. 8B is a front view illustrating the rotatable driving mechanism of FIG. 8A.

FIG. 8A is a side view illustrating a rotatable driving mechanism 800 to be applicable to the variable speed reducing mechanisms 118-1 and 118-2 described above. FIG. 8B is a front view illustrating the rotatable driving mechanism 800 of FIG. 8A.

Referring to FIGS. 8A and 8B, the rotatable driving mechanism 800 to the semi-sphere-shaped roller 72 includes a worm wheel 77, a worm gear 78, and a worm gear shaft 79. Both ends of the worm gear shaft 79 are supported by the support plates 41 and 42. A torque limiter 43' is mounted on one end of the worm gear shaft 79. The outer ring of the torque limiter 43' is fixed to the support plate 41 to brake with slip torque. This configuration is referred to as a torque brake 45.

The worm wheel 77 is mounted on one end of the second shaft 75. The worm wheel 77 is disposed to connect the driving with the worm gear 78. The first shaft 74 and the second shaft 75 are attached to the retaining member 73 so that the semi-sphere-shaped roller 72 mounted on the first shaft 74 becomes rotatable due to rotation of the second shaft 75. Due to the large speed reduction ratio by the worm gear 78 and the worm wheel 77, the semi-sphere-shaped roller 72 becomes capable of locking the own rotation of the semi-sphere-shaped roller 72.

According to this configuration, both the variable speed reducing mechanism 118-1 and the variable speed reducing mechanism 118-2 include the torque brake 45 and a drive train unit 700. The torque brake 45 rotates when a torque equal to or greater than a given value is applied. The drive train unit 700 extends from the second shaft 75 to the torque brake 45. The drive train unit 700 locks rotation about the second shaft 75 at a large speed reduction ratio. The rotatable driving mechanism 800 functions as an assisting device to perform control of a tension force accurately.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A tension controller, comprising:

a drive device configured to rotate a drive shaft; and a drive transmission device configured to transmit a rotation driving force of the drive shaft of the drive device to rotate a rotary shaft of a roll of a conveyance target medium, the drive transmission device including a tension applying device, the tension applying device including a variable speed reducing device and a torque limiter, the variable speed reducing device and the torque limiter being disposed between the drive shaft of the drive device and the rotary shaft of the roll of the conveyance target medium, the variable speed reducing device being configured to change a speed reduction ratio between the rotary shaft of the roll of the conveyance target medium and the torque limiter and apply a tension force to the conveyance target medium, wherein the variable speed reducing device includes conical rollers rotatably supported and coaxially disposed facing each other;

a semi-sphere-shaped roller disposed in contact with a side face of one of the conical rollers and a side face of an opposed one of the conical rollers; and a pressing body configured to press the semi-sphere-shaped roller to the side face of the one of the conical rollers and the side face of the opposed one of the conical rollers, the semi-sphere-shaped roller is configured to rotate about a shaft, with an axis of the shaft passing a center of the semi-sphere-shaped roller in a direction vertical to axes of the conical rollers, and rotate about another shaft that passes the center of the semi-sphere-shaped roller in a direction vertical to the axis of the shaft, and when a first distance from an axial center of said another shaft to a contact point at which the semi-sphere-shaped roller that is rotated about the shaft contacts the one of the conical rollers and a second distance from the axial center of said another shaft to a contact point at which the semi-sphere-shaped roller that is rotated about the shaft contacts the opposed one of the conical rollers are changed, a speed reduction ratio of the conical rollers is varied is varied continuously.

2. The tension controller according to claim 1, wherein the pressing body includes an elastic body to bias the semi-sphere-shaped roller toward the side face of the one of the conical rollers and the side face of the opposed one of the conical rollers.

3. The tension controller according to claim 1, wherein the variable speed reducing device includes:

a torque brake configured to rotate when receiving a torque equal to or greater than a given value is applied; and a drive train extending from the shaft to the torque brake and configured to lock rotation about the shaft at a large speed reduction ratio.

4. The tension controller according to claim 1, further comprising:

a first detector mounted on another rotary shaft that rotates due to the rotation driving force of the drive device, the first detector configured to detect a direction of rotation of said another rotary shaft of the first detector and an amount of rotation of said another rotary shaft of the first detector;

a second detector mounted on the rotary shaft of the roll of the conveyance target medium, the second detector configured to detect a direction of rotation of the rotary shaft of the roll of the conveyance target medium and an amount of rotation of the rotary shaft of the roll of the conveyance target medium; and circuitry configured to control the drive device based on a detection result of the first detector and a detection result of the second detector and apply the tension force to the conveyance target medium via the tension applying device, wherein the circuitry is further configured to:

determine a speed reduction ratio of the tension applying device based on a differential value of the amount of rotation of the rotary shaft in the detection result of the first detector and the detection result of the second detector; and reflect a determination result of the speed reduction ratio when controlling the drive device.

5. A medium conveying device comprising:

the tension controller according to claim 4;

a medium supplying device disposed upstream from a sheet conveying device that conveys the conveyance target medium in a conveying direction, the medium supplying device to supply the conveyance target medium; and a medium take-up device disposed downstream from the sheet conveying device in the conveying direction, the medium take-up device to take up the conveyance target medium, wherein the tension controller is disposed in at least one of the medium supplying device and the medium take-up device.

6. An image forming apparatus comprising:

the medium conveying device according to claim 5; and an image forming device configured to form an image on the conveyance target medium conveyed by the medium conveying device.

7. A tension controller, comprising:

a drive device configured to rotate a drive shaft; and a drive transmission device configured to transmit a rotation driving force of the drive shaft of the drive device to rotate a rotary shaft of a roll of a conveyance target medium, the drive transmission device including a tension applying device, the tension applying device including a variable speed reducing device and a torque limiter, the variable speed reducing device and the torque limiter being disposed between the drive shaft of the drive device and the rotary shaft of the roll of the conveyance target medium, the variable speed reducing device being configured to change a speed reduction ratio between the rotary shaft of the roll of the conveyance target medium and the torque limiter and apply a tension force to the conveyance target medium, wherein the controller further comprises:

a first detector mounted on another rotary shaft that rotates due to the rotation driving force of the drive device, the first detector configured to detect a direction of rotation of said another rotary shaft of the first detector and an amount of rotation of said another rotary shaft of the first detector;

a second detector mounted on the rotary shaft of the roll of the conveyance target medium, the second detector configured to detect a direction of rotation of the rotary shaft of the roll of the conveyance target medium and an amount of rotation of the rotary shaft of the roll of the conveyance target medium; and circuitry configured to control the drive device based on a detection result of the first detector and a detection result of the second detector and apply the tension force to the conveyance target medium via the tension applying device, and wherein the circuitry is further configured to determine a speed reduction ratio of the tension applying device based on a differential value of the amount of rotation of the rotary shaft in the detection result of the first detector and the detection result of the second detector; and reflect a determination result of the speed reduction ratio when controlling the drive device.

* * * * *